US010914550B1

(12) United States Patent
Dirlam

(10) Patent No.: US 10,914,550 B1
(45) Date of Patent: Feb. 9, 2021

(54) HOLSTER ACCESSORY

(71) Applicant: Lawrence Bruce Dirlam, Victoria, MN (US)

(72) Inventor: Lawrence Bruce Dirlam, Victoria, MN (US)

( * ) Notice: Subject to any disclaimer, the term of this patent is extended or adjusted under 35 U.S.C. 154(b) by 0 days.

(21) Appl. No.: 16/408,402

(22) Filed: May 9, 2019

Related U.S. Application Data

(63) Continuation of application No. 14/829,626, filed on Aug. 18, 2015, now abandoned.

(60) Provisional application No. 62/038,953, filed on Aug. 19, 2014.

(51) Int. Cl.
*F41C 33/00* (2006.01)
*F41C 33/02* (2006.01)

(52) U.S. Cl.
CPC ..... *F41C 33/02* (2013.01)

(58) Field of Classification Search
CPC .. F41C 33/02; F41C 33/0209; F41C 33/0227; A01K 97/10; A45F 3/04
USPC ..... 224/192, 193, 198, 238, 243, 581
See application file for complete search history.

(56) References Cited

U.S. PATENT DOCUMENTS 2,910,804 A * 11/1959 White ..... F41C 33/0263 2/300
3,003,670 A 10/1961 Stella
4,022,361 A * 5/1977 Devlin ..... A45F 5/021 224/192
4,258,871 A * 3/1981 McMahon ..... F41C 33/046 224/192
4,475,675 A 10/1984 Miles
5,495,967 A * 3/1996 Parton ..... A45C 3/06 190/106
6,131,198 A * 10/2000 Westrick ..... F41C 33/0209 2/102
6,296,164 B1 * 10/2001 Russo ..... A61F 5/449 224/581
6,481,528 B2 11/2002 Antonio
6,990,887 B1 * 1/2006 O'Donnell ..... F41H 5/08 89/36.02
7,204,395 B2 * 4/2007 Gallagher ..... A45F 5/02 224/192
D620,705 S 8/2010 Beard et al.
8,479,331 B2 * 7/2013 Craighead ..... F41C 33/041 5/503.1
8,672,201 B2 3/2014 Craighead
9,404,710 B1 * 8/2016 Beard ..... F41C 33/0209
2014/0014699 A1 * 1/2014 Larko ..... F41C 33/041 224/587
2014/0158733 A1 * 6/2014 McDonnell ..... B60R 7/14 224/587

(Continued)

FOREIGN PATENT DOCUMENTS

WO 2004090463 A1 10/2004

*Primary Examiner* — Peter N Helvey
(74) *Attorney, Agent, or Firm* — William R Berggren; Berggren Law Offices LLC

(57) ABSTRACT

A holster accessory apparatus that is configures to modify existing holsters to allow for more comfortable carrying of a gun with an exposed grip. The accessory comprises two elements, a flexible material larger than the perimeter of a combination of a gun holster and an attaching element configures to affix the holster to the flexible material. In one embodiment, method is designed for conceal and carry situations.

10 Claims, 7 Drawing Sheets

(56) References Cited

U.S. PATENT DOCUMENTS

| | | | | |
|---|---|---|---|---|
| 2014/0224847 | A1* | 8/2014 | Miller | F41C 33/04<br>224/183 |
| 2015/0144673 | A1* | 5/2015 | Dahl | F41C 33/00<br>224/587 |
| 2015/0230592 | A1* | 8/2015 | Knutson | F41C 33/02<br>224/191 |
| 2016/0091279 | A1* | 3/2016 | Massaro, Jr. | F41C 33/04<br>224/581 |

* cited by examiner

HOLSTER ACCESSORY

FIELD OF THE INVENTION

This invention relates to an accessory for a gun holster and in particular to an accessory for a concealed and carry gun holster.

BACKGROUND OF THE INVENTION

There is a need for a gun holster accessory that allows the carrying of a holster with or without a belt, particularly a concealed holster, in a manner that provides more comfort to the carrier.

Guns are typically held in holsters that only partially cover the gun to permit quick access to the gun in times of need. As a result, the part of the gun that is exposed, generally the handle, hammer, and at times the trigger guard are exposes to the body or clothes on the body. The exposed parts of the gun may snag on the clothing or result in chafing or irritation on the body area not covered with clothing but in contact with the exposed part of the gun.

Concealed guns are required to be carried by most law enforcement personnel in the United States. The various guns while in the various holsters are uncomfortable for the person, often causing abrasions and chafing to the skin when worn without underclothing between the gun and the body part adjacent to the gun.

Very few holsters are known that leave the handle of the gun exposed for quick access and have a barrier between the exposed handle and the body of the person carrying the gun to prevent the problems of chaffing and snagging as discussed above. No method is currently known to modify existing holsters to have such a barrier.

There is still a need for a gun holster accessory that is able to modify current gun holsters with exposed gun handles to prevent contact of the exposed part of the gun with clothing or with parts of the adjacent body that is not covered with some form of clothing to prevent snagging or chaffing.

SUMMARY OF THE INVENTION

I have invented a gun holster accessory that prevents contact of the exposed part of the gun with adjacent parts of the body with or without additional clothing between the exposed part of the gun and the body. The gun holster accessory comprises two aspects, an apparatus aspect and a method aspect. The apparatus aspect is a gun holster accessory that comprises two elements. The first element is a flexible material with a front, a back, a thickness, and a first perimeter that is larger than a second perimeter of a combination of a holster and a gun with an exposed handle in the holster for easy gun access wherein the holster has a surface that is able to be attached to the front of the flexible material. The second element is an attaching element configured to affix the front of the flexible material to the surface of at least one gun holster such that the first perimeter encompasses the second perimeter of each gun and holster combination that is affixed to the flexible material.

The method aspect is composed of a method of using a gun holster accessory apparatus that comprises at least five steps. The first step is providing a first gun holster with gun. The second step is providing a holster accessory apparatus that comprises two elements. The first element is a flexible material with a front, a back, a thickness, and a first perimeter that is larger than a second perimeter of a combination of a gun with an exposed handle in the holster for easy gun access wherein the holster has a surface that is able to be attached to the front of the flexible material. The second element is an attaching element configured to affix the front of the flexible material to the surface of at least one gun holster such that the first perimeter of encompasses the second perimeter of each gun and holster combination that is affixed to the flexible material. The third step is affixing the attaching element to the front of the flexible material. The fourth step is affixing the attaching element to the surface of the first gun holster sufficiently for the first perimeter to encompass the second perimeter. The fifth step is placing the holster accessory apparatus attached to the first gun holster in a location near a body of a person desiring to carry a gun so that irritation to the body of the person caused by the exposed gun in the holster for easy gun access or snagging of clothing worn by the person caused by the exposed gun in the holster is minimized.

The invention has at least three advantages. First, the invention eliminates either the chafing of the body of a person carrying the gun, particularly in a concealed and carry manner, from the exposed parts of a gun against or the snagging of clothing by the same exposed parts of the gun worn by the same person with clothing between the gun and the body. Second, the invention is useable for most if not all holsters where the part of the gun is exposed for rapid use and the holster is not built with a barrier between the combination of holster and gun and the body of the person carrying the gun. Third, the accessory material may be applied to more than one holster with a similar second perimeter.

Figure 1:
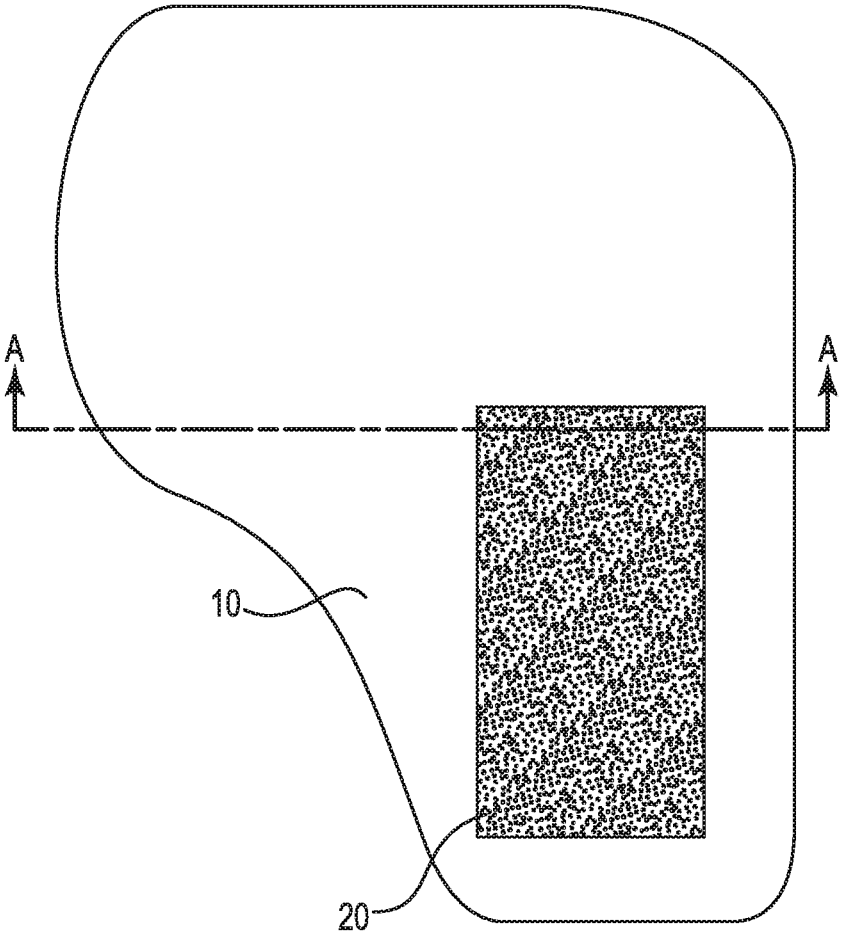
FIG. 1 illustrates an embodiment of the invention showing an embodiment of the flexible material of the invention affixed to an embodiment of an attaching element.

While the invention is amenable to various modifications and alternative forms, specifics have been shown by way of example in the drawings and will be described in detail below. It is to be understood, however, that the intention is not to limit the invention to the particular embodiments described. On the contrary, the invention is intended to cover all modifications, equivalents, and alternatives falling within the scope of the invention as defined by the appended claims.

DETAILED DESCRIPTION OF SOME EMBODIMENTS OF THE INVENTION

Current holsters worn for protection with gun grips exposed for quick access have problem relating to comfort. Frequently additional gun parts are exposed such as the trigger and the end of the barrel. This discomfort is particularly true for concealed and carried holsters. Either the gun parts exposed to the body of the person carrying the holstered gun chafe the skin of the person or they snag clothing if clothing is worn between the exposed gun part and the body of the person.

There are various types of holsters with exposed gun grips. These included holsters that are worn outside the waist band (OWB), inside the waist band (IWB), affixed to a bra, and over the shoulder. In addition, there is a recent addition of a clip holster to carry extra clips for guns that use clips. Generally, comfort and/or snagging of clothing is a persistent problem with most if not all of these holsters. My invention solves the comfort and chafing problem by providing a holster accessory that may be used to modify current holsters to eliminate that cause of discomfort. This is particularly beneficial with concealed and carry holsters that are often worn for extended periods of time and when not working, i.e., off-duty.

In addition, my invention has many additional benefits. It is easy to maintain. It will conform to the body of a person carrying my invention affixed to a holster with gun. Some embodiments make drawing a gun easier. Some embodiments work with most OWB and IWB holsters. Some embodiments may increase comfort with many bra and over-the shoulder holsters. Keeps a gun from poking or rubbing the skin raw of a person carrying it in a holster. May be used year round. Protects the gun from body moisture. Some embodiments allow some use of the gun and holster without use of the invention when the invention is removable from the holster. Works with holsters designed to carry various guns including, for example, mini, small, medium, and large frame guns. Easy to install on a holster. May be adjusted to the angle of carry of a person. May be trimmed for individual preference. Easy to use when sitting. These and other benefits will become apparent with further description of the different aspects of the invention.

The invention has two aspects, an apparatus aspect and a method of use aspect. The apparatus aspect is a gun holster accessory that comprises two elements. The first element is a flexible material with a front, a back, a thickness, and a first perimeter that is larger than a second perimeter of a combination of a holster and a gun with an exposed handle in the holster for easy gun access wherein the holster has a surface that is able to be attached to the front of the flexible material.

The flexible material accomplishes at least two features. It is stiff enough to prevent the flexible material from draping over the gun in the holster when the flexible material is affixed to the holster with the gun and retain the first perimeter with the withdrawing of the gun. It is also flexible enough to comfortably conform to the curvatures of a body affixed to the holster and gun when carried by a person. These characteristics are most influenced by material and thickness. Other characteristics that are beneficial include, for example, be able to breath, i.e., pass gas between the body and the environment, and be substantially resistant to moisture such as perspiration. Suitable materials include, for example, leather, plastic, or a combination of leather and plastic. Some embodiments are of leather because leather minimizes sweating between a person's skin and the flexible material of the invention. Other Suitable thicknesses, depending on the material, range from at least 1.5 millimeter (mm) to not greater than 6.0 mm. Some embodiments range from at least 2.0 mm to not greater than 5.0 mm. Some embodiments range from 2.7 mm to 4.5 mm. Some embodiments have a thickness that is at least 3.1 mm but mot greater than 3.6 mm.

The second element is an attaching element configured to affix the front of the flexible material to the surface of at least one gun holster such that the first perimeter encompasses the second perimeter of each gun and holster combination that is affixed to the flexible material. In some embodiments, the attaching element may be sized to a type of holster or split into more than one attaching sections where the attaching element is not pre-adhered to the flexible material. This may be desirable in some situations to achieve better attachment of the holster to the flexible material.

In some aspects where the gun accessory is used only to modify an existing holster, the attaching element may be a sheet of substrate such as, for example, plastic with a layer of adhesive on both sides. If the attaching element is pre-adhered to the flexible material, then the adhesive layer not affixed to the flexible material is covered with a release liner until that adhesive layer is affixed to a holster. If the attaching element is not pre-adhered to the flexible material, then both adhesive layers are covered with a release liner until they are affixed to their respective surfaces, the flexible material and the holster, in such a manner that the first perimeter encompasses the second perimeter.

Figure 2:
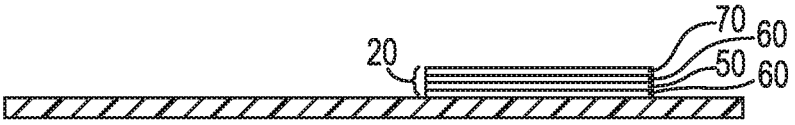
FIG. 2 illustrates a cross section of the embodiment shown in FIG. 1.

An embodiment of this aspect where the attaching element is pre-adhered to the flexible material is illustrated in FIG. 1 and FIG. 2. FIG. 1 illustrates an embodiment of the invention showing an embodiment of the flexible material of the invention affixed to an embodiment of an attaching element. A flexible material (10) is pre-adhered to an attaching element (20). FIG. 2 illustrates a cross section of the embodiment shown in FIG. 1 along line of sight A. Attaching element 20 is composed of a substrate (50) coated with an adhesive layer (60) on both sides. A release liner (70) covers the adhesive layer that is not affixed to the flexible material.

In some aspects where the gun accessory is used only to temporarily modify an existing holster, the flexible material is releasably affixed to the holster such that the first perimeter encompasses the second perimeter. One embodiment of attaching element includes two sheets of substrate with adhesive on one side of each and a mechanical fastener arrangement such as, for example, a hook surface and a loop surface on the other sides, respectively, that may be detached and reattached with extension and compression force. If the attaching element is pre-adhered to the flexible material, then the adhesive layer not affixed to the flexible material is covered with a release liner until that adhesive layer is affixed to a holster. If the attaching element is not pre-adhered to the flexible material, then both adhesive layers are covered with a release liner until they are affixed to their respective surfaces, the flexible material and the holster, in such a manner that the first perimeter encompasses the second perimeter. To minimize shagging of clothing when the flexible material is removed from the holster, the part of the attaching element that is affixed to the holster includes the loop surface and the part affixed to the flexible material includes the hook surface. However, other embodiments may reverse this when other situations are considered.

In some embodiments, the flexible material may be releasably affixed to more than one holster. In these embodiments, more than one part of the attaching element configured to affix to the holster is provided.

Figure 3:
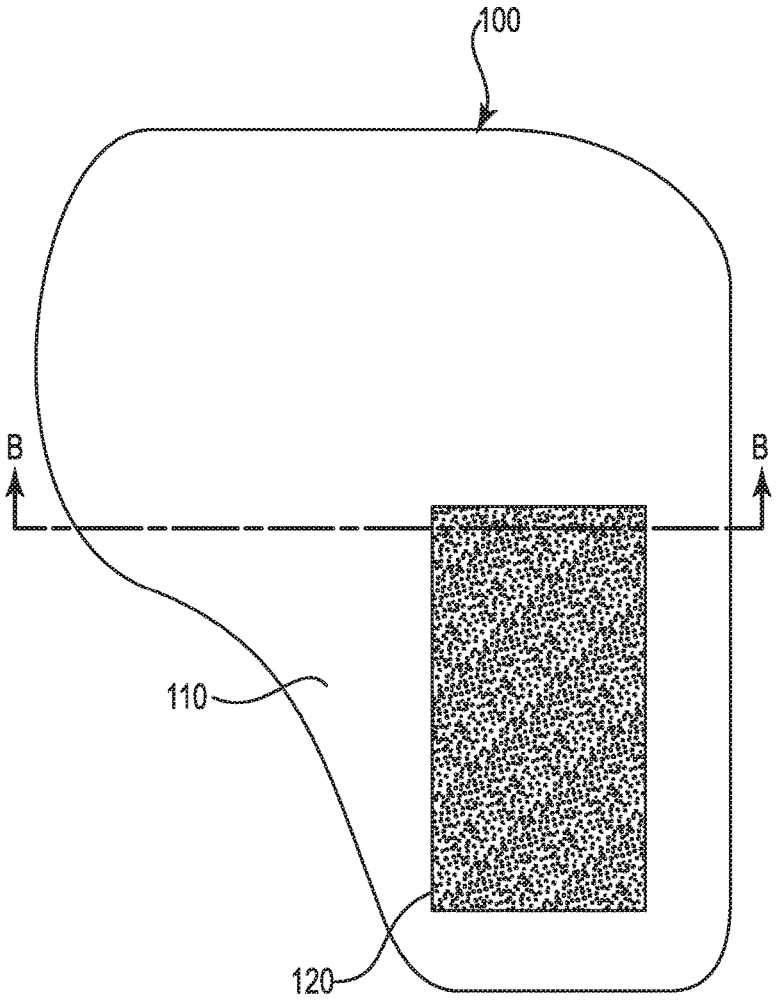
FIG. 3 illustrates a partial embodiment of the invention showing embodiment of the flexible material of the invention affixed to part of an embodiment of an attaching element.
Figure 5:
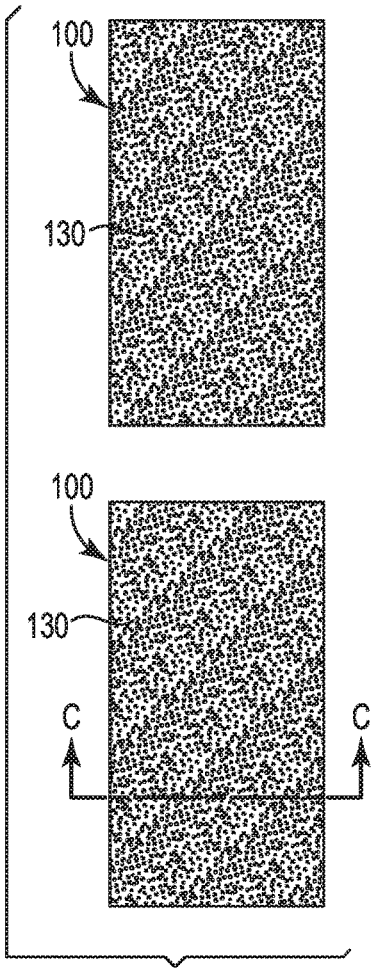
FIG. 5 illustrates a partial embodiment of the invention showing additional parts of an embodiment of the attaching element not shown in FIG. 3 that are able to be affixed to two holsters with similar perimeters for each holster and gun combination.
Figure 4:
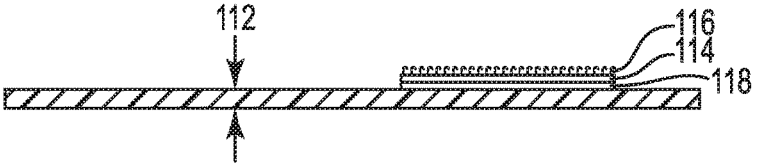
FIG. 4 illustrates a cross section of the partial embodiment shown in FIG. 3.
Figure 6:
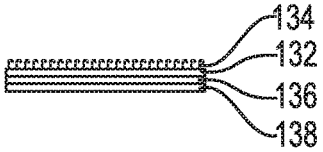
FIG. 6 illustrates a cross section of one of the parts of the attaching element shown in FIG. 5.

An embodiment of this aspect where more than one holster is intended to be affixed to the flexible material is illustrated in FIGS. 3, 4, 5, and 6. FIG. 3 illustrates a partial embodiment of the invention showing embodiment of the flexible material of the invention affixed to part of an embodiment of an attaching element. A flexible material (110) is pre-adhered to part of an attaching element (120). FIG. 4 illustrates a cross section of the partial embodiment shown in FIG. 3 along line of sight B. Flexible material 110 with a thickness (112) is shown with part of an attaching element including a substrate (114) with an adhesive layer (118) and a hook surface (116), all not to scale. FIG. 5 illustrates a partial embodiment of the invention showing additional parts (130) of an embodiment of the attaching element not shown in FIG. 3 that are able to be affixed to two holsters with similar perimeters for each holster and gun combination. FIG. 6 illustrates a cross section of one of the parts of the attaching element shown in FIG. 5 along line of sight C. Partial attaching element 130 includes a substrate (132) affixed to a layer of loop material (134), and also to a layer of adhesive (136) that is in turn attached to a release liner (138). One partial attaching element 130 is to affix to one holster and the second partial attaching element 130 is to affix to a second holster.

Figure 7:
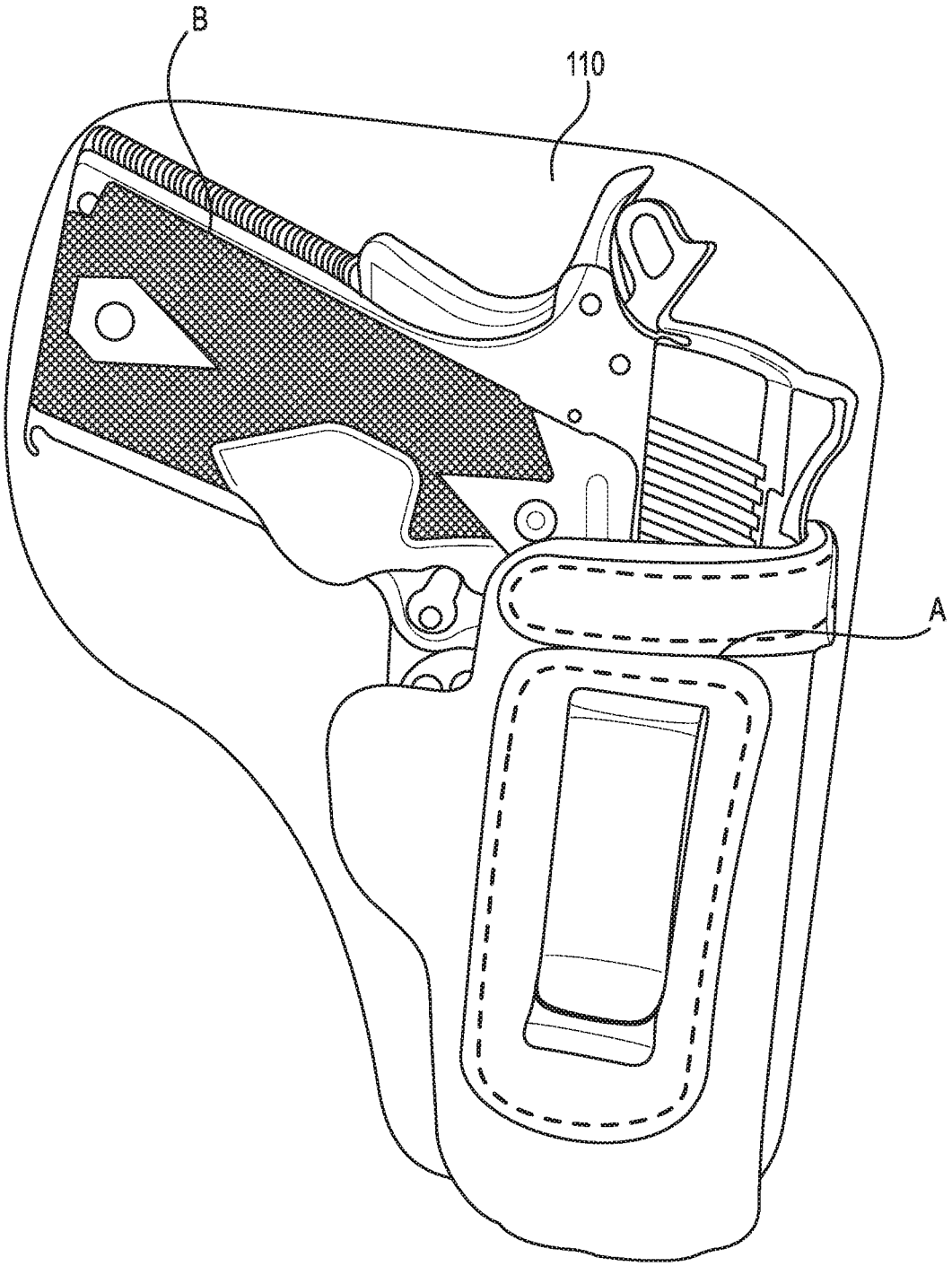
FIG. 7 illustrates an embodiment of the invention shown in FIG. 3 and FIG. 4 used with a holster and gun suitable for being carried by a person.

FIG. 7 illustrates an embodiment of the invention shown in FIG. 3 and FIG. 4 used with a holster and gun suitable for being carried by a person. Flexible material 110 is affixed to a holster (A) that contains a partially exposed gun (B). As seen, the perimeter of the flexible material encompasses the perimeter of holster A and gun B.

Figure 8:
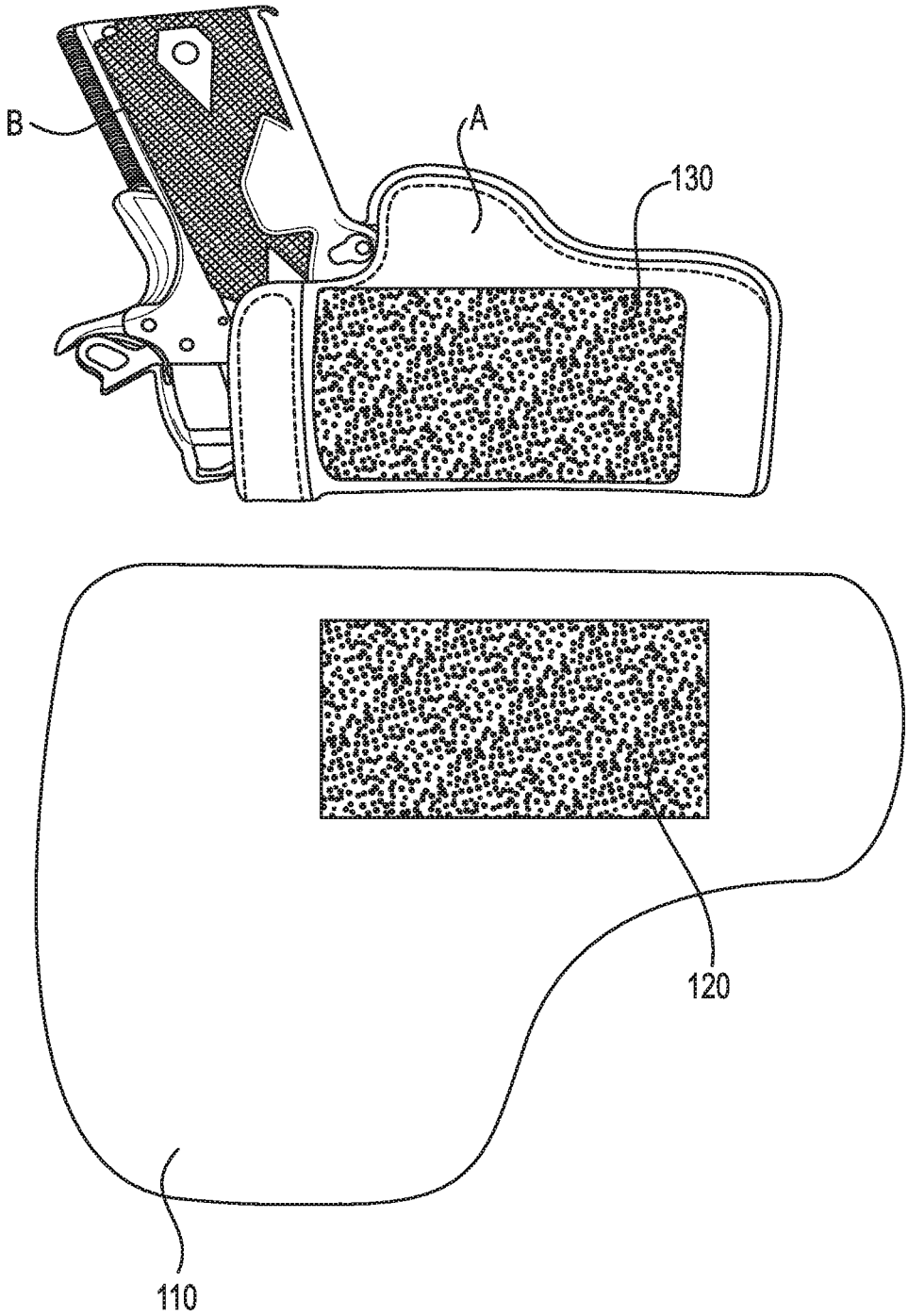
FIG. 8 illustrates the embodiment of FIG. 7 separated into (1) a gun in a holster with part of the attaching element and (2) a flexible material with another part of the attaching element suitable to attaching to another holster with a second part of the attaching element (not shown).

FIG. 8 illustrates the embodiment of FIG. 7 separated into (1) a gun in a holster with first part of the attaching element and (2) a flexible material with first second part of the attaching element suitable to attaching to another holster with a second second part of the attaching element (not shown). Flexible material 110 is shown affixed to part of attaching element 120. Holster A with gun B is shown affixed to part of attaching element 130.

In some embodiments, the holster that is to be affixed to the gun holster accessory apparatus may be larger than convention holsters and include, for example, a crossover holster. In these situations, the invention may include a pair of attaching elements. In some embodiments the attaching element is configured with at least one first sheet having a first side and a second side and at least one second sheet with a first side and a second side, the first side of the first sheet is configured to affix to the front of flexible material, the first side of the second sheet is configured to affix to the surface of at least one gun holster, and the second side of the first sheet is configured to releasably affix the second side of the second sheet.

Figure 9:
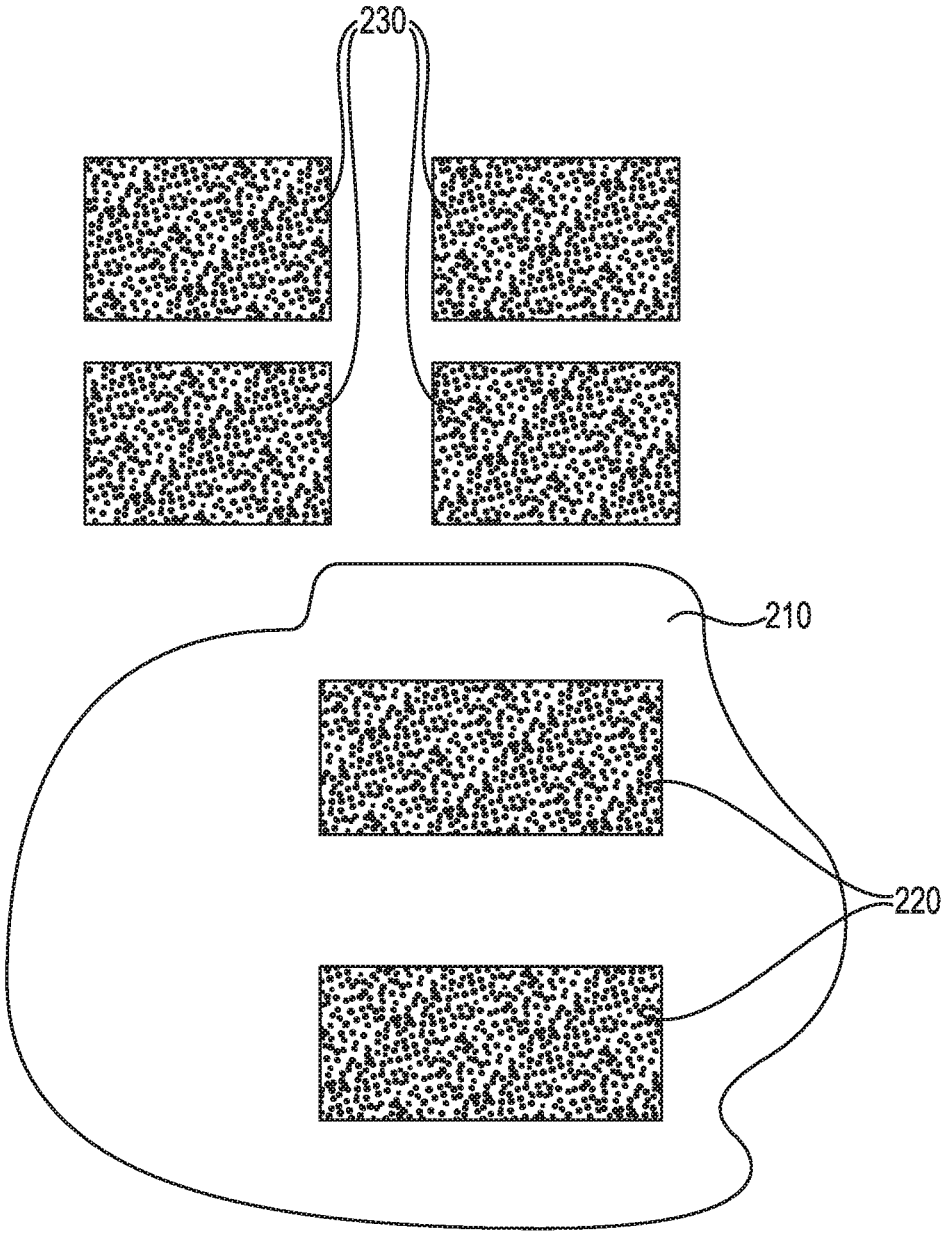
FIG. 9 illustrates another embodiment of the invention used with a crossover holster and gun showing an embodiment of a gun holster accessory apparatus suitable for releasable attachment to two crossover holsters with similar perimeter for the gun and holster combination.
Figure 10:
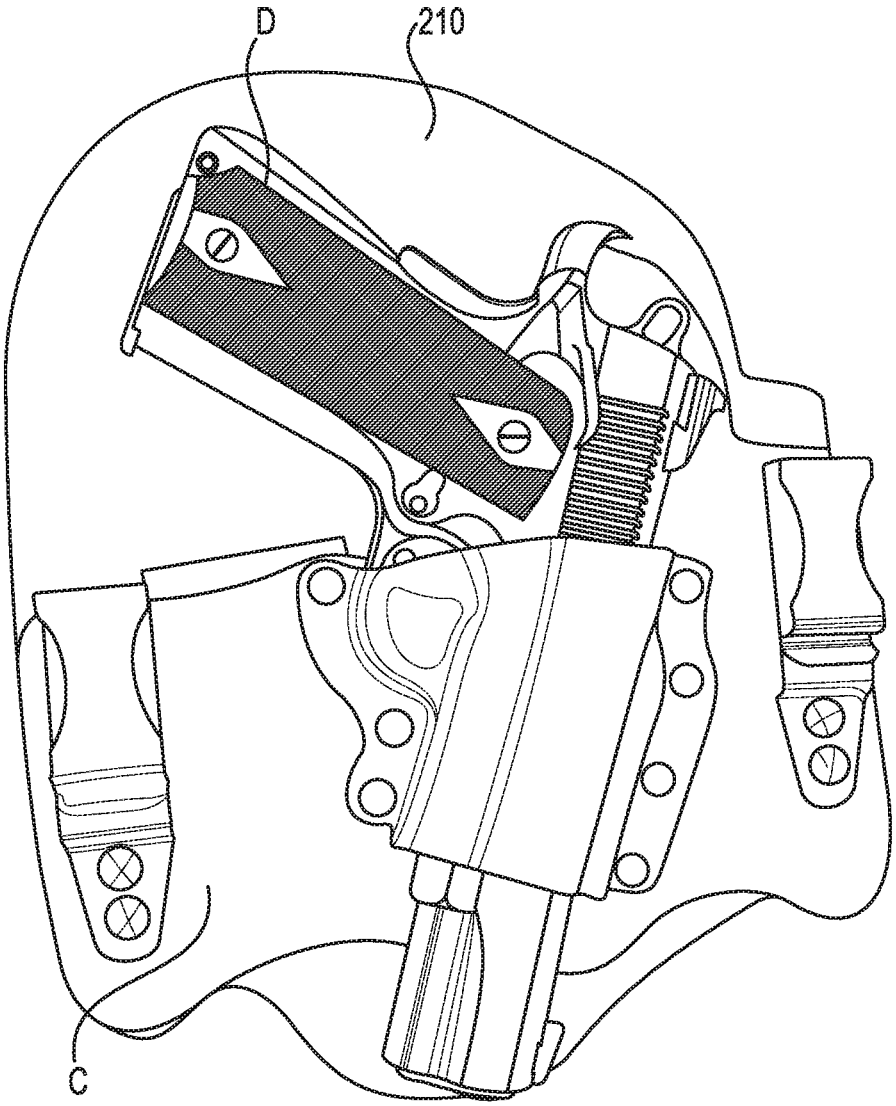
FIG. 10 illustrates the embodiment shown in FIG. 9 attached to a crossover holster with gun combination suitable for carrying by a person.
Figure 11:
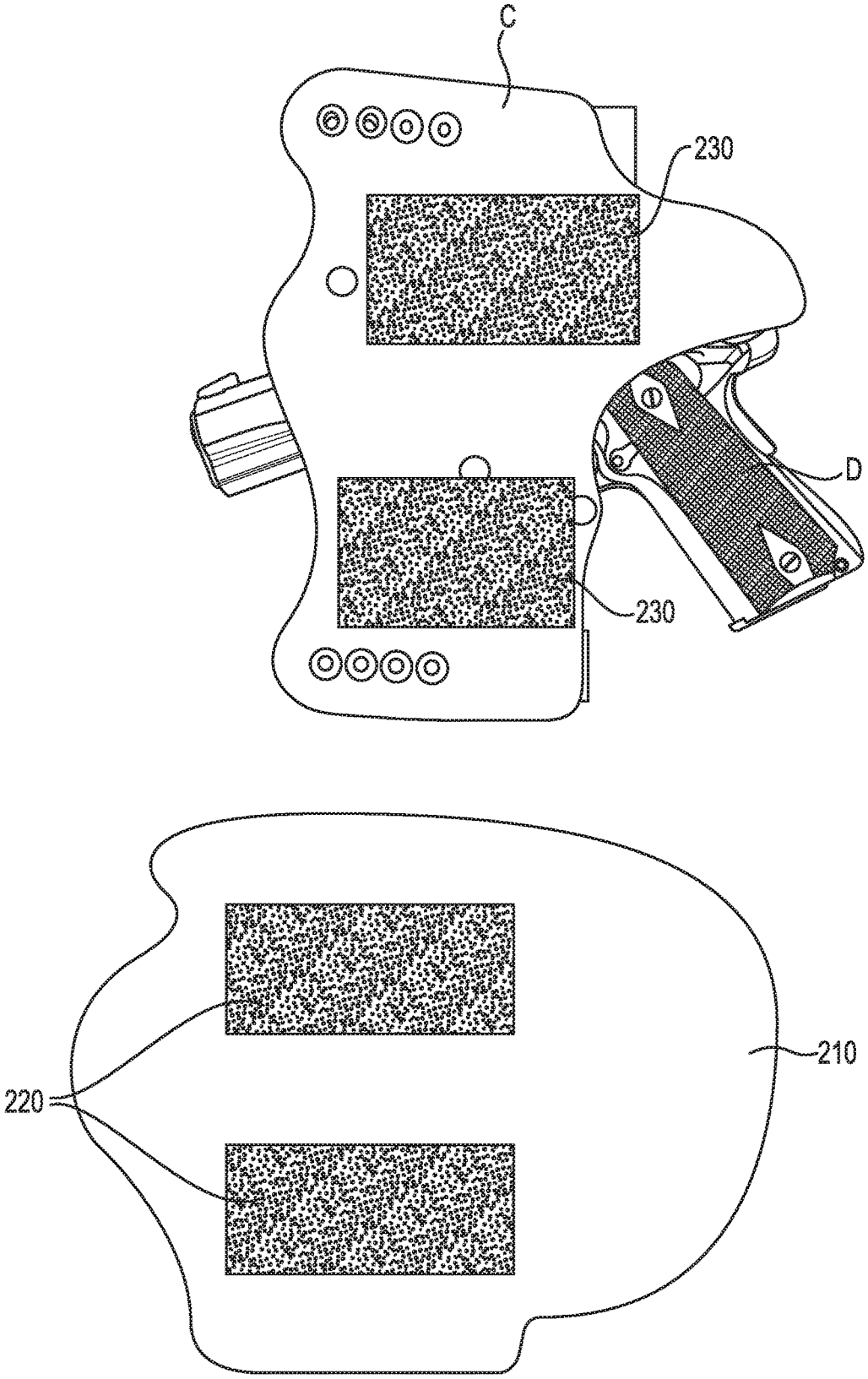
FIG. 11 illustrates the embodiment of FIG. 10 separated into (1) a gun in a crossover holster with part of the attaching element and (2) a flexible material with another part of the attaching element suitable to attaching to another crossover holster with a second part of the attaching element (not shown).

FIGS. 9, 10, and 11 illustrate an embodiment of the invention suitable for large holsters such as crossover holsters. FIG. 9 illustrates another embodiment of the invention used with a crossover holster and gun showing an embodiment of a gun holster accessory apparatus suitable for releasable attachment to two crossover holsters with similar perimeter for the gun and holster combination. Flexible material 210 is affixed to two pieces of first partial attaching element (220). Four pieces of second part partial attaching element (230) are shown that are suitable for affixing to two crossover holsters (not shown). FIG. 10 illustrates the embodiment shown in FIG. 9 attached to a crossover holster with gun combination suitable for carrying by a person. Flexible material 210 is shown affixed to a crossover holster (C) with a gun (D). FIG. 11 illustrates the embodiment of FIG. 10 separated into (1) a gun in a crossover holster with part of the attaching element and (2) a flexible material with another part of the attaching element suitable to attaching to another crossover holster with a second part of the attaching element (not shown). Two first partial attachment elements 220 are shown affixed to flexible material 210. Two second partial attaching elements 230 are shown attached to crossover holster D carrying a gun D that is partially exposed.

The method aspect is composed of a method of using a gun holster accessory apparatus that comprises at least five steps. The first step is providing a first gun holster with gun. The second step is providing a holster accessory apparatus that comprises two elements. The first element is a flexible material with a front, a back, a thickness, and a first perimeter that is larger than a second perimeter of a combination of a gun with an exposed handle in the holster for easy gun access wherein the holster has a surface that is able to be attached to the front of the flexible material. The second element is an attaching element configured to affix the front of the flexible material to the surface of at least one gun holster such that the first perimeter of encompasses the second perimeter of each gun and holster combination that is affixed to the flexible material. The third step is affixing the attaching element to the front of the flexible material. The fourth step is affixing the attaching element to the surface of the first gun holster sufficiently for the first perimeter to encompass the second perimeter. The fifth step is placing the holster accessory apparatus attached to the first gun holster in a location near a body of a person desiring to carry a gun so that irritation to the body of the person caused by the exposed gun in the holster for easy gun access or snagging of clothing worn by the person caused by the exposed gun in the holster is minimized.

In some embodiments, the flexible material is releasably affixed to the holster. This permits use at times with the flexible material removed from the holster. As stated above, when using hook and loop mechanical fasteners to obtain releasable attachment, the loop side may be more beneficial with the holster and the hook side may be more beneficial with the flexible material.

In some embodiments, the holster accessory apparatus is beneficially attached to the first gun holster with gun is in a location on the person that is concealed from the view of another person.

In some embodiments, gun accessory attached to the first gun holster is in a location and orientation with respect to the person that permits easy access to the gun by the person.

In some embodiments, the attaching element is configured with a first sheet having a first side and a second side and at least a first and second second sheet each with a first side and a second side. The first side of the first sheet is configured to affix to the front of flexible material. The first side of the second sheet is configured to affix to the surface of one gun holster. The second side of the first sheet is configured to releasably affix the second side of second sheet such that the first perimeter encompasses the second perimeter.

In some embodiments, the attaching element is configured with a pair of first sheets each having a first side and a second side and a pair of second sheets each with a first side and a second side. The first sides of each of the first sheets are configured to affix to the front of flexible material. The first sides of the pair of second sheets is configured to affix to the surface of one gun holster, The second side of each of the first sheets is configured to releasably affix the second side of each of the second sheets such that the first perimeter encompasses the second perimeter.

In some embodiments, the method comprises four additional steps. The first additional step is providing a second holster with gun. The second additional step is detaching the second side of the first sheet of the attachment element from the second side of the first second sheet of the attachment element. The third additional step is affixing the first side of the second second sheet of the attaching element to the surface of the second gun holster. The fourth additional step is attaching the second side of the first sheet of the attachment element to the second side of the second second sheet of the attachment element to reattaching the first holster to the flexible material sufficiently to cover the perimeter of the combination of second gun holster and gun when a gun is placed in the second gun holster.

In some embodiments, the method just described involving a first gun and holster combination and a second gun and holster combination involves additional first sheets and second sheets for use with guns in large holsters such as, for example, crossover holsters. The attaching element is configured with two first sheets each having a first side and a second side and a first and second pair of first and second sheets each with a first side and a second side. The first sides of each of the first sheets are configured to affix to the front of flexible material. The first sides of the first pair of second sheets are configured to affix to the surface of one gun holster. The first sides of the second pair of second sheets are configured to affix to the surface of a second gun holster. The second sides of each of the first sheets are configured to releasably affix the second sides of either the first pair or second pair of second sheets such that the first perimeter encompasses the second perimeter in both combinations of gun and holster.

Other modifications and changes made to fit particular operating requirements and environments will be apparent to those with ordinary skill in the art. Thus, the invention is not considered limited to the embodiments discussed for purposes of disclosure and covers all changes and modifications that do not constitute departures from the true spirit and scope of this invention.

What is claimed is:

1. A method of using a gun holster accessory apparatus, comprising the steps of:

providing at least a first gun holster having a gun in the holster with at least a handle exposed for easy gun access, a first surface on the outside of one side of the first gun holster and a first perimeter surrounding the first gun holster and the gun in the holster with at least an exposed handle;

providing a holster accessory apparatus, comprising:

a flexible material layer with a front, a back, a thickness, and a second perimeter that is larger than and encompasses the first perimeter and configured to only contact the holster on the one side of the holster, to not drape over the holster and the gun in the holster and to conform to a body of a person desiring to carry the holster and gun in the holster, and an attaching element configured to affix the front of the flexible material to the first surface of at least the first gun holster;

affixing the attaching element to the front of the flexible material layer;

affixing the attaching element to the first surface of the first gun holster wherein the second perimeter encompass the first perimeter; and placing the holster accessory apparatus attached to the first gun holster in a location in contact with the skin of a body or underclothing of the person desiring to carry a gun so that the holster and gun are facing outward from the body of a person and the back of the flexible material layer is facing the body of the person to minimize the exposed gun in the holster from causing irritation to the body of the person or snagging of the underclothing of the person between the holster and the body of the person during wearing of the holstered gun by the person.

2. The method of using a gun holster accessory apparatus of claim 1 wherein the attaching element is configured to releasably affix the front of the flexible material layer to the first surface of at least the first gun holster.

3. The method of using a gun holster accessory apparatus of claim 1 wherein the attaching element is configured with at least one first sheet having a first side and a second side and at least one second sheet with a first side and a second side, the first side of the first sheet is configured to affix to the front of the flexible material layer, the first side of the second sheet is configured to affix to the first surface of at least the first gun holster, and the second side of the first sheet is configured to releasably affix to the second side of the second sheet.

4. The method of using a gun holster accessory apparatus of claim 1 wherein the attaching element comprises two first sheets that are affixed to the front of the flexible material layer and at least two second sheets that are configured to be affixed to the first surface of at least the first gun holster.

5. The method of using a gun holster accessory apparatus of claim 1 wherein the flexible material layer is stiff enough to prevent the flexible material layer from draping over the gun in the at least a first gun holster when the flexible material layer is affixed to the first gun holster with the gun and flexible enough to allow the flexible material layer to comfortably conform to the curvatures of a body when the gun holster accessory affixed to at least a first gun holster with gun is carried by a person.

6. The method of using a gun holster accessory apparatus of claim 1 wherein the flexible material layer is from a group consisting of leather, plastic, or a combination of leather and plastic, and has a thickness of from 1.5 mm to 6.0 mm.

7. The method of using a gun holster accessory apparatus of claim 1 wherein the flexible material layer is from a group consisting of leather, plastic, or a combination of leather and plastic, and has a thickness of from 2.0 mm to 5.0 mm.

8. The method of using a gun holster accessory apparatus of claim 1 wherein the flexible material layer is substantially resistant to the penetration of water.

9. The method of using a gun holster accessory apparatus of claim 1 wherein the combination of the accessory attached to the first surface of the holster with gun is in a location on the person that is concealed from the view of another person.

10. The method of claim 3 further, comprises the steps of:

providing a second gun holster having a gun with at least a handle exposed for easy gun access, a first surface on the outside of one side of the second gun holster and a third perimeter surrounding the second gun holster and the gun with at least an exposed handle that is encompassed by the first perimeter;

providing an attaching element with another second sheet;

affixing the first side of the other second sheet of the attaching element to the first surface of the second gun holster;

detaching the second side of the first sheet of the attachment element from the second side of the first second sheet of the attaching element; and attaching the second side of the first sheet of the attachment element to the second side of the other second sheet of the attachment element to attach the flexible material layer to the first surface of the second holster sufficiently for the second perimeter to encompass the third perimeter.

* * * * *